US011859916B2

(12) United States Patent
Akahani et al.

(10) Patent No.: US 11,859,916 B2
(45) Date of Patent: Jan. 2, 2024

(54) FLOW PATH MEMBER FOR HEAT EXCHANGER, AND HEAT EXCHANGER

(71) Applicant: NGK INSULATORS, LTD., Nagoya (JP)

(72) Inventors: Tatsuya Akahani, Nagoya (JP); Tatsuo Kawaguchi, Mizuho (JP); Makoto Yoshihara, Iwakura (JP)

(73) Assignee: NGK INSULATORS, LTD., Nagoya (JP)

( * ) Notice: Subject to any disclaimer, the term of this patent is extended or adjusted under 35 U.S.C. 154(b) by 0 days.

(21) Appl. No.: 17/447,704

(22) Filed: Sep. 15, 2021

(65) Prior Publication Data

US 2022/0228810 A1 Jul. 21, 2022

(30) Foreign Application Priority Data

Jan. 18, 2021 (JP) ..... 2021-005990

(51) Int. Cl.
*F28D 7/10* (2006.01)
*F28F 13/12* (2006.01)
*F01N 5/02* (2006.01)

(52) U.S. Cl.
CPC ..... *F28D 7/10* (2013.01); *F01N 5/02* (2013.01); *F28F 13/12* (2013.01)

(58) Field of Classification Search
CPC .... F28D 7/10; F28D 7/106; F01N 5/02; F28F 13/12; F28F 13/08
USPC ..... 165/109.1
See application file for complete search history.

(56) References Cited

U.S. PATENT DOCUMENTS

2014/0020877 A1* 1/2014 Suzuki ..... F28F 1/02 165/181
2016/0003550 A1* 1/2016 Tokuda ..... F28D 21/0003 165/140
2016/0084198 A1* 3/2016 Miyairi ..... F02G 1/043 60/516

(Continued)

FOREIGN PATENT DOCUMENTS

DE 11 2014 006 300 T5 11/2016
JP 2009-024565 A 2/2009

(Continued)

OTHER PUBLICATIONS

German Office Action (Application No. 10 2021 210 460.6) dated Apr. 20, 2022 (with English translation).

*Primary Examiner* — Tho V Duong
*Assistant Examiner* — Raheena R Malik
(74) *Attorney, Agent, or Firm* — BURR PATENT LAW, PLLC

(57) ABSTRACT

A flow path member for a heat exchanger includes: an inner cylinder capable of housing a heat recovery member through which a first fluid can flow; an outer cylinder having a feed port capable of feeding a second fluid and a discharge port capable of discharging the second fluid, the outer cylinder being disposed so as to be spaced on a radially outer side of the inner cylinder such that a flow path for the second fluid is formed between the outer cylinder and the inner cylinder; a feed pipe connected to the feed port; and a discharge pipe connected to the discharge port. The feed port and the discharge port are provided so as to be located in a distance of less than half the circumference of the outer cylinder in a circumferential direction.

11 Claims, 13 Drawing Sheets

(56) References Cited

U.S. PATENT DOCUMENTS

| | | | | |
|---|---|---|---|---|
| 2016/0153719 | A1* | 6/2016 | Tokuda | F28D 7/106 165/140 |
| 2016/0341489 | A1* | 11/2016 | Ichiyanagi | F28F 13/06 |
| 2018/0066560 | A1 | 3/2018 | Kawaguchi et al. | |
| 2018/0142967 | A1* | 5/2018 | Kawaguchi | F28D 21/0003 |
| 2018/0230884 | A1* | 8/2018 | Kawaguchi | F01N 5/02 |
| 2019/0277570 | A1* | 9/2019 | Kawaguchi | F01P 3/14 |
| 2019/0301807 | A1* | 10/2019 | Kawaguchi | F28F 7/02 |
| 2020/0003496 | A1* | 1/2020 | MacKelvie | F28D 21/0012 |
| 2020/0141299 | A1* | 5/2020 | Kawaguchi | H01L 35/32 |
| 2020/0309463 | A1* | 10/2020 | Yoshihara | F28D 20/00 |
| 2020/0309464 | A1* | 10/2020 | Fumoto | F28D 21/0003 |
| 2020/0309471 | A1* | 10/2020 | Hamada | F28F 9/005 |
| 2021/0080184 | A1* | 3/2021 | Fumoto | F28D 7/1676 |
| 2021/0080185 | A1* | 3/2021 | Fumoto | F01N 3/2828 |
| 2021/0080187 | A1* | 3/2021 | Fumoto | F01N 9/00 |

FOREIGN PATENT DOCUMENTS

| | | | | |
|---|---|---|---|---|
| JP | 2009024565 | A | * | 2/2009 |
| JP | 2019-184224 | A | | 10/2019 |
| WO | 2016/185963 | A1 | | 11/2016 |

* cited by examiner

FLOW PATH MEMBER FOR HEAT EXCHANGER, AND HEAT EXCHANGER

FIELD OF THE INVENTION

The present invention relates to a flow path structure for a heat exchanger, and a heat exchanger.

BACKGROUND OF THE INVENTION

Recently, there is a need for improvement of fuel economy of motor vehicles. In particular, a system is expected that worms up a coolant, an engine oil and an automatic transmission fluid (ATF: Automatic Transmission Fluid) at an early stage to reduce friction losses, in order to prevent deterioration of fuel economy at the time when an engine is cold, such as when the engine is started. Further, a system is expected that heats an exhaust gas purifying catalyst in order to activate the catalyst at an early stage.

As the systems as described above, for example, there is a heat exchanger. The heat exchanger is a device that exchanges heat between a first fluid and a second fluid by allowing the first fluid to flow inside and the second fluid to flow outside. In such a heat exchanger, for example, the heat can be effectively utilized by exchanging the heat from the first fluid having a higher temperature (for example, an exhaust gas) to the second fluid having a lower temperature (for example, cooling water). For example, Patent Literature 1 proposes a heat exchanger including: a pillar shaped honeycomb structure having a partition wall that defines a plurality of cells to form flow paths of a first fluid; and a casing arranged so as to cover an outer peripheral surface of the pillar shaped honeycomb structure, wherein the casing has an inner cylinder and an outer cylinder, and a flow path for a second fluid is formed between the inner cylinder and the outer cylinder.

CITATION LIST

Patent Literature

[Patent Literature 1] WO 2016/185963 A1

SUMMARY OF THE INVENTION

The present invention is specified as follows:

The present invention relates to a flow path member for a heat exchanger, comprising:

an inner cylinder capable of housing a heat recovery member through which a first fluid can flow;

an outer cylinder having a feed port capable of feeding a second fluid and a discharge port capable of discharging the second fluid, the outer cylinder being disposed so as to be spaced on a radially outer side of the inner cylinder such that a flow path for the second fluid is formed between the outer cylinder and the inner cylinder;

a feed pipe connected to the feed port; and a discharge pipe connected to the discharge port, wherein the feed port and the discharge port are provided so as to be located in a distance of less than half the circumference of the outer cylinder in a circumferential direction, and wherein resistance of the flow path for the second fluid on a shorter circumference side between the feed port and the discharge port is higher than that of the flow path for the second fluid on a longer circumference side between the feed port and the discharge port.

Also, the present invention relates to a flow path member for a heat exchanger, comprising:

an inner cylinder capable of housing a heat recovery member through which a first fluid can flow;

an outer cylinder having a feed port capable of feeding a second fluid and a discharge port capable of discharging the second fluid, the outer cylinder being disposed so as to be spaced on a radially outer side of the inner cylinder such that a flow path for the second fluid is formed between the outer cylinder and the inner cylinder;

a feed pipe connected to the feed port; and a discharge pipe connected to the discharge port, wherein the feed port and the discharge port are provided so as to be located in a distance of less than half the circumference of the outer cylinder in a circumferential direction, wherein the feed port and the discharge port are located on the same circumference of the outer cylinder, and wherein the flow path member comprises at least one of a flow path resistance increasing structure portion provided at the flow path for the second fluid on a shorter circumference side between the feed port and the discharge port, and a flow path resistance increasing member provided at the flow path for the second fluid on the shorter circumference side between the feed port and the discharge port.

Also, the present invention relates to a flow path member for a heat exchanger, comprising:

an inner cylinder capable of housing a heat recovery member through which a first fluid can flow;

an outer cylinder having a feed port capable of feeding a second fluid and a discharge port capable of discharging the second fluid, the outer cylinder being disposed so as to be spaced on a radially outer side of the inner cylinder such that a flow path for the second fluid is formed between the outer cylinder and the inner cylinder;

a feed pipe connected to the feed port; and a discharge pipe connected to the discharge port, wherein the feed port and the discharge port are provided so as to be located in a distance of less than half the circumference of the outer cylinder in a circumferential direction, wherein the feed port and the discharge port are located on the same circumference of the outer cylinder, and wherein, in a cross section orthogonal to a flow direction of the first fluid, the inner cylinder is eccentric such that a central portion of the inner cylinder is located on the feed port and discharge port side relative to a central portion of the outer cylinder.

Further, the present invention relates to a heat exchanger, comprising:

the flow path member for the heat exchanger; and a heat recovery member housed in the inner cylinder.

DETAILED DESCRIPTION OF THE INVENTION

The heat exchanger described in Patent Literature 1 is provided with a feed port and a discharge port for the second fluid in a distance of less than half the circumference of the outer cylinder in a circumferential direction. Therefore, it causes a problem that the second fluid fed from the feed port more easily flows through a shorter circumferential side flow path between the feed port and the discharge port than through a longer circumferential side flow path between the feed port and the discharge port, resulting in a lower heat recovery amount (heat exchange amount).

The present invention has been made to solve the above problems. An object of the present invention is to provide a flow path member for a heat exchanger, and a heat exchanger, which can improve a heat recovery amount.

According to the present invention, it is possible to provide a flow path member for a heat exchanger, and a heat exchanger, which can improve a heat recovery amount.

Hereinafter, embodiments of the present invention will be specifically described with reference to the drawings. It is to understand that the present invention is not limited to the following embodiments, and those which appropriately added changes, improvements and the like to the following embodiments based on knowledge of a person skilled in the art without departing from the spirit of the present invention fall within the scope of the present invention.

Embodiment 1

(1) Flow Path Member for Heat Exchanger

Figure 1:
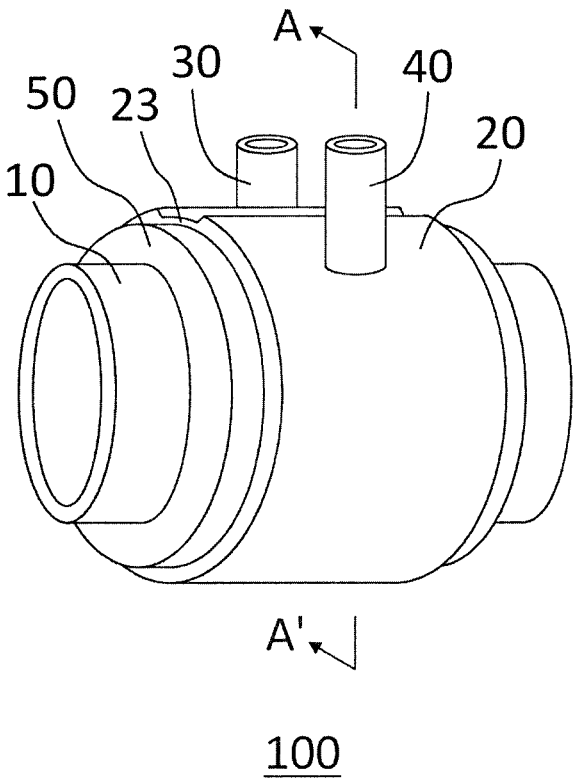
FIG. 1 is a perspective view of a flow path member for a heat exchanger according to Embodiment 1 of the present invention.
Figure 2:
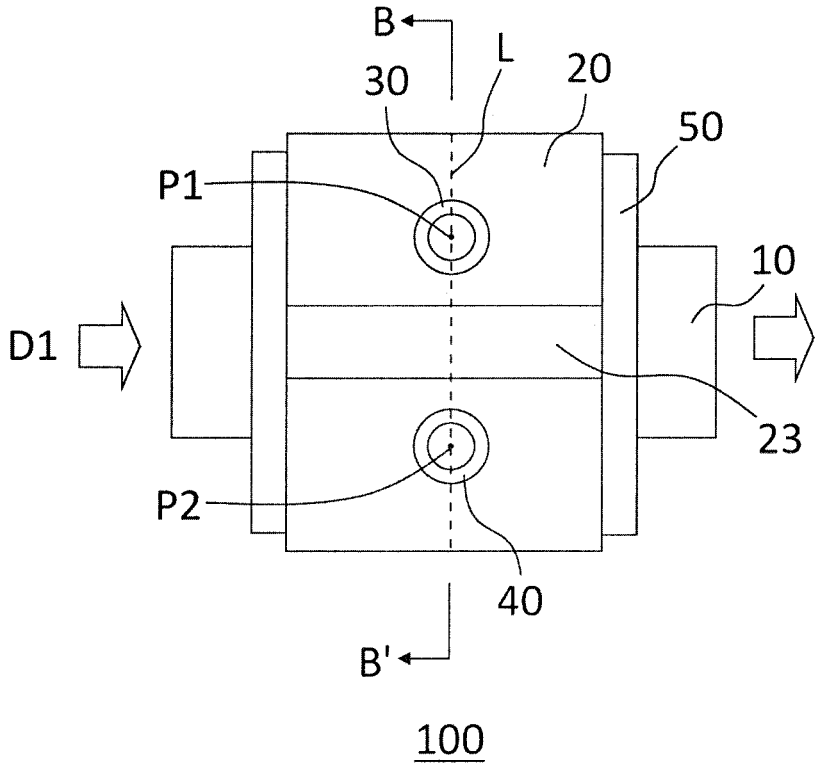
FIG. 2 is a top view of the flow path member for the heat exchanger in FIG. 1.
Figure 3:
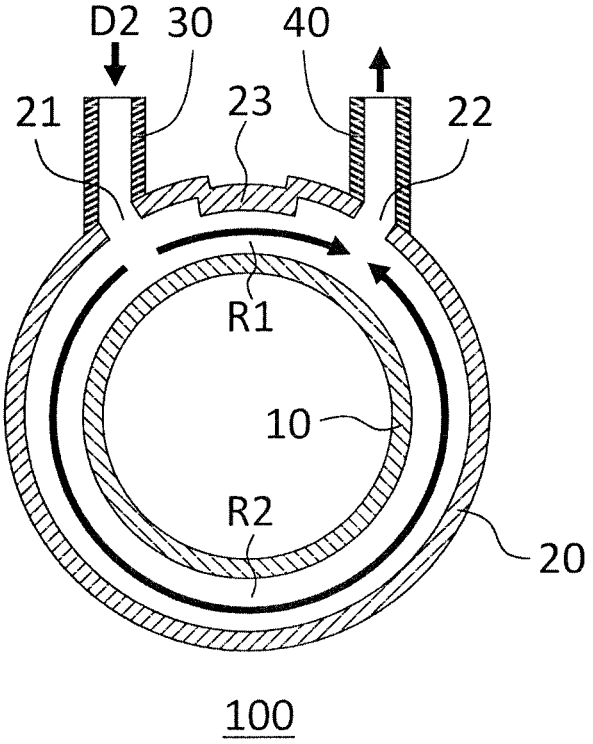
FIG. 3 is a cross-sectional view taken along the line A-A in FIG. 1 and the line B-B' in FIG. 2.

FIG. 1 is a perspective view of a flow path member for a heat exchanger according to Embodiment 1 of the present invention. FIG. 2 is a top view of the flow path member for the heat exchanger in FIG. 1. FIG. 3 is a cross-sectional view of the A-A' line in FIG. 1 and the B-B' line in FIG. 2 (a direction orthogonal to an axial direction of an outer cylinder and an inner cylinder).

A flow path member 100 for a heat exchanger according to Embodiment 1 of the present invention includes: an inner cylinder 10 capable of housing a heat recovery member through which a first fluid can flow; an outer cylinder 20 having a feed port 21 capable of feeding a second fluid and a discharge port 22 capable of discharging the second fluid, the outer cylinder 20 being disposed so as to be spaced on a radially outer side of the inner cylinder 10 such that a flow path R1, R2 for the second fluid is formed between the outer cylinder 20 and the inner cylinder 10; a feed pipe 30 connected to the feed port 21; and a discharge pipe 40 connected to the discharge port 22. Further, the feed port 21 and the discharge port 22 of the outer cylinder 20 are provided so as to be located in a distance of less than half the circumference of the outer cylinder 20 in a circumferential direction.

Although FIG. 1 shows an example in which the inner cylinder 10 and the outer cylinder 20 are connected by a connecting member 50, the inner cylinder 10 and the outer cylinder 20 may be directly connected by increasing diameters of both end portions of the inner cylinder 10 and/or decreasing diameters of both end portions of the outer cylinder 20.

Figure 4:
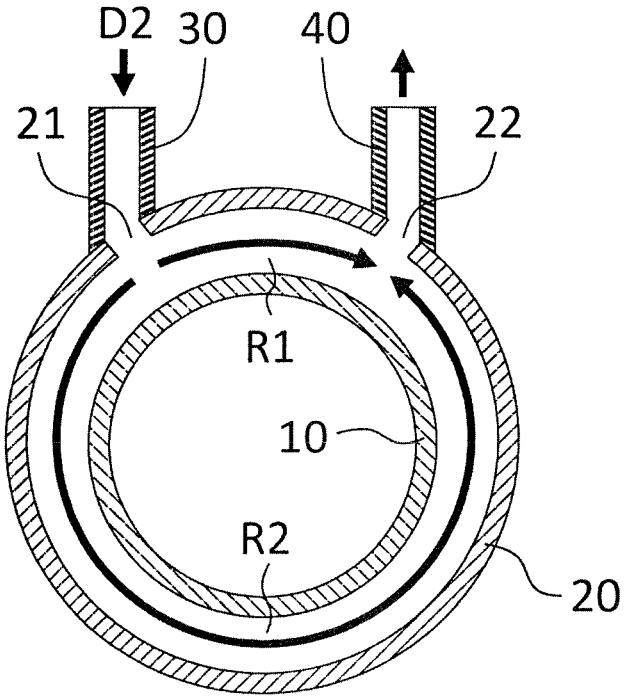
FIG. 4 is a cross-sectional view of a flow path member for a conventional heat exchanger in a direction orthogonal to an axial direction of an outer cylinder and an inner cylinder.

Here, FIG. 4 shows a cross-sectional view of a flow path member for a conventional heat exchanger in a direction orthogonal to an axial direction of an outer cylinder and an inner cylinder.

In the flow path member for the conventional heat exchanger, a second fluid fed from the feed pipe 30 through the feed port 21 passes through any one of a flow path R1 for the second fluid on the shorter circumference side between the feed port 21 and the discharge port 22, and a flow path R2 for the second fluid on the longer circumference side between the feed port 21 and the discharge port 22, and is discharged from the discharge pipe 40 through the discharge port 22. In FIG. 4, the arrows indicate a flow direction D2 of the second fluid. However, the second fluid has a higher rate at which it passes through the flow path R1 for the second flow path on the shorter circumference side where a distance between the feed port 21 and the discharge port 22 is shorter, than through the flow path R2 for the second fluid on the longer circumference side where the distance between the feed port 21 and the discharge port 22 is longer, so that it has a lower opportunity to bring the second fluid into contact with the inner cylinder 10, which is one of reasons for a decrease in the heat recovery amount.

In an embodiment, the flow path member 100 for the heat exchanger according to Embodiment 1 of the present invention has a flow path resistance (a resistance of the flow path R1) for the second fluid on the shorter circumference side between the feed port 21 and the discharge port 22, lower than a flow path resistance (a resistance of the flow path R2) for the second fluid on the longer circumference side between the feed port 21 and the discharge port 22. By thus controlling the flow path resistance, a rate at which the second fluid passes through the flow path R2 for the second fluid on the longer circumference side where the distance between the feed port 21 and the discharge port 22 is longer is increased as compared with the flow path R1 for the second fluid on the shorter circumference side where the distance between the feed port 21 and the discharge port 22 is shorter, so that an opportunity to bring the second fluid into contact with the inner cylinder 10 can be increased, and the heart recovery amount can be increased. The flow path resistance for the second fluid on the shorter circumference side and the flow path resistance for the second fluid on the longer circumference side can be obtained, for example, by the following method. The flow path resistance for the second fluid on the shorter circumference side can be calculated from a pressure loss when the flow path for the second fluid on the longer circumference side is blocked and the second fluid (e.g., water) is circulated at 10 L/min. Also, the flow path resistance for the second fluid on the longer circumference side can be calculated from pressure loss when the flow path for the second fluid on the shorter circumference side is blocked and the second fluid (e.g., water) is circulated at 10 L/min.

As a method of increasing the flow path resistance for the second fluid on the shorter circumference side between the feed port 21 and the discharge port 22 as compared with the flow path resistance for the second fluid on the longer circumference side between the feed port 21 and the discharge port 22, a flow path resistance increasing structure portion 23 may be provided at the flow path R1 for the second fluid on the shorter circumference side between the feed port 21 and the discharge port 22, or a flow path resistance increasing member may be arranged in the flow path R1 for the second fluid on the shorter circumference side between the feed port 21 and the discharge port 22, or a combination of these may be used, although not particularly limited thereto.

The flow path resistance increasing structure portion 23 can be provided at the inner cylinder 10, the outer cylinder 20, or both, which face the flow path R1 for the second fluid. However, the flow path resistance increasing structure portion 23 may preferably be provided at the outer cylinder 20 in terms of productivity. Similarly, the flow path resistance increasing member may be provided at the inner cylinder 10, the outer cylinder 20, or both, which face the flow path R1 for the second fluid. However, the flow path resistance increasing member may preferably be provided at the outer cylinder 20 in terms of productivity.

The flow path resistance increasing structure portion 23 and the flow path resistance increasing member are different from each other in that the former is a portion formed by shaping the inner cylinder 10 and/or the outer cylinder 20, whereas the latter is a member provided separately from the inner cylinder 10 and/or the outer cylinder 20.

Here, each of FIGS. 1 to 3 shows an example of the case where the flow path resistance increasing structure portion 23 is provided at the outer cylinder 20 facing the flow path R1 for the second fluid on the shorter circumference side between the feed port 21 and the discharge port 22. Other examples are shown in FIGS. 5 to 7.

Figure 5:
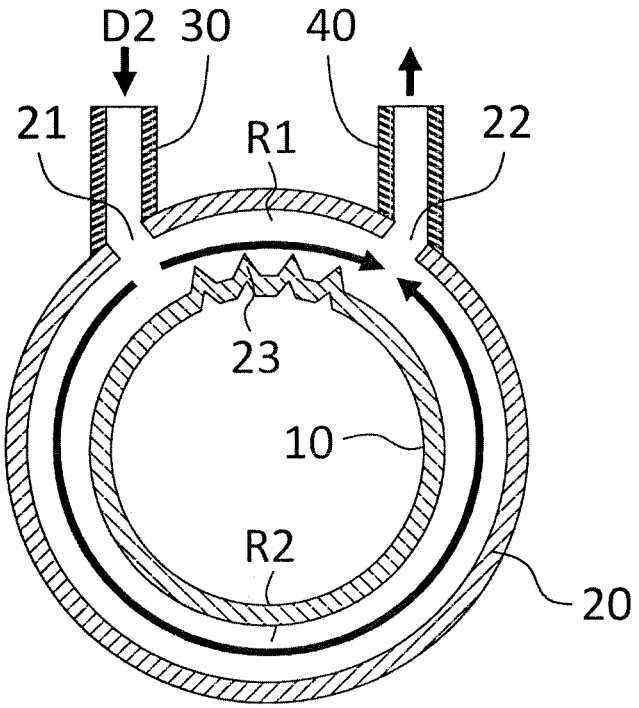
FIG. 5 is a cross-sectional view of a flow path member for another heat exchanger according to Embodiment 1 of the present invention in a direction orthogonal to an axial direction of an outer cylinder and an inner cylinder.

FIG. 5 is an example of the case where the flow path resistance increasing structure portion 23 is provided at the inner cylinder 10 facing the flow path R1 for the second fluid on the shorter circumference side between the feed port 21 and the discharge port 22.

Figure 6:
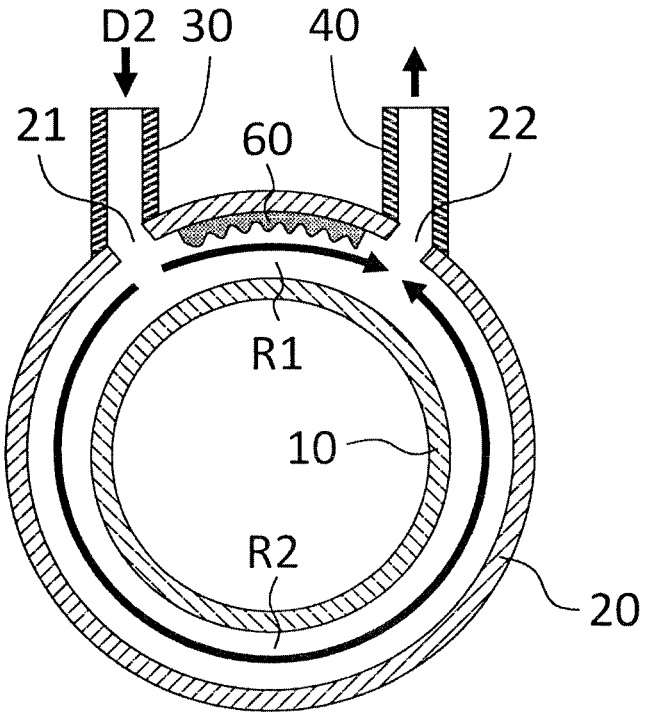
FIG. 6 is a cross-sectional view of a flow path member for another heat exchanger according to Embodiment 1 of the present invention in a direction orthogonal to an axial direction of an outer cylinder and an inner cylinder.
Figure 7:
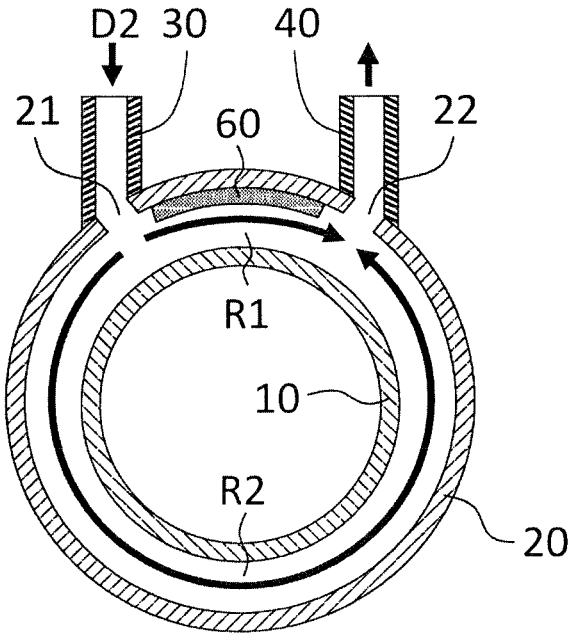
FIG. 7 is a cross-sectional view of a flow path member for another heat exchanger according to Embodiment 1 of the present invention in a direction orthogonal to an axial direction of an outer cylinder and an inner cylinder.

Each of FIGS. 6 and 7 shows an example of the case where the flow path resistance increasing member 60 is arranged at the outer cylinder 20 facing the flow path R1 for the second fluid on the shorter circumference side between the feed port 21 and the discharge port 22.

Figure 8:
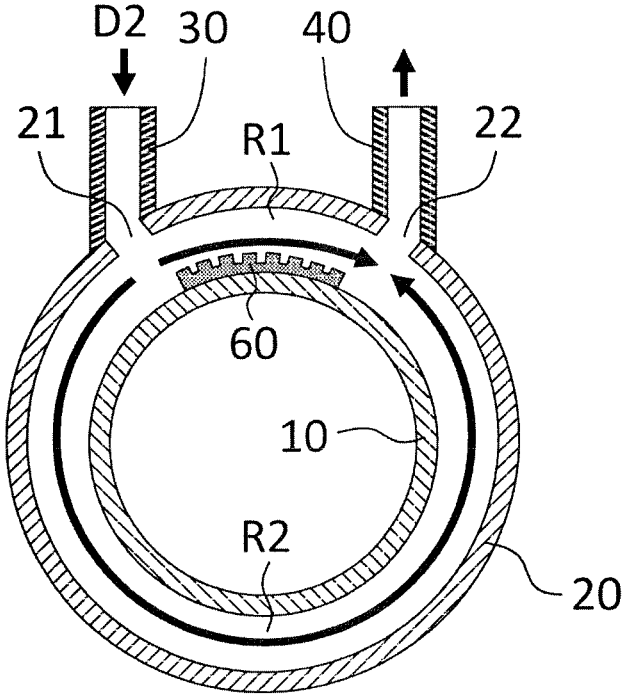
FIG. 8 is a cross-sectional view of a flow path member for another heat exchanger according to Embodiment 1 of the present invention in a direction orthogonal to an axial direction of an outer cylinder and an inner cylinder.

FIG. 8 is an example of the case where the flow path resistance increasing member 60 is arranged at the inner cylinder 10 facing the flow path R1 for the second fluid on the shorter circumference side between the feed port 21 and the discharge port 22.

Each of FIGS. 5 to 8 is a cross-sectional view of the flow path member for the heat exchanger in the direction orthogonal to the axial direction of the outer cylinder and the inner cylinder. The perspective views and the top views of the flow path member for the heat exchanger are omitted, because they are easily understood with reference to FIGS. 1 to 3.

It is preferable that the flow path resistance increasing structure portion 23 and/or the flow path resistance increasing member 60 are provided along the flow direction D1 of the first fluid. Thus, the provision of the flow path resistance increasing structure portion 23 and/or the flow path resistance increasing member 60 can further increase the rate at which the second fluid passes through the flow path R2 for the second fluid on the longer circumference side having the longer distance between the feed port 21 and the discharge port 22, so that the heat recovery amount can be further increased.

The flow path resistance increasing structure portion 23 and/or the flow path resistance increasing member 60 preferably have a structure capable of partially reduce the cross-sectional area of the flow path for the second fluid, as shown in FIGS. 3 and 5-8. Such a structure can allow the flow path resistance for the second fluid to be increased.

The structure capable of partially reducing the cross-sectional area of the flow path for the second fluid is not limited to any particular structure, and can be a variety of structures including shapes such as those shown in FIGS. 3 and 5-8. The flow path resistance increasing member 60 as shown in FIGS. 6-8 may be divided into a plurality of parts, and its width, thickness, and the like may be adjusted as needed. Among these structures, a bellows structure as shown in FIG. 6 is preferred. Since the bellows structure has a larger surface area, the heat exchange easily take place even in the flow path R1 for the second fluid on the shorter circumference side having the shorter distance between the feed port 21 and the discharge port 22, so that the heat recovery amount can be increased.

Hereinafter, the flow path member 100 for the heat exchanger will be described in detail for each member.

<Regarding Inner Cylinder 10>

The inner cylinder 10 is a cylindrical member capable of housing a heat recovery member through which the first fluid can pass.

The inner cylinder 10 may have any shape such as a cylindrical shape having a circular cross section perpendicular to the axial direction, a rectangular cylindrical shape having a triangular, quadrangular, pentagonal, or hexagonal cross section, and an elliptical cylindrical shape having an elliptical cross section, although not particularly limited thereto. Among them, the inner cylinder 10 is preferably cylindrical.

An inner peripheral surface of the inner cylinder 10 may be in direct or indirect contact with an outer peripheral surface of the heat recovery member in the axial direction (the flow path direction D1 of the first fluid). However, in terms of thermal conductivity, it is preferable that the inner peripheral surface of the inner cylinder is in direct contact with the axial outer peripheral surface of the heat recovery member. In this case, a cross-sectional shape of the inner peripheral surface of the inner cylinder 10 coincides with a cross-sectional shape of the outer peripheral surface of the heat recovery member. Also, it is preferable that the axial direction of the first inner cylinder 10 coincides with that of the heat recovery member, and a central axis of the inner cylinder 10 coincides with that of the heat recovery member.

Diameters (outer and inner diameters) of the inner cylinder 10 are not particularly limited. However, it is preferable that the diameters of both end portions in the axial direction are increased. Such a structure can allow the inner cylinder 10 to be directly joined to the outer cylinder 20, thus eliminating any need for a connecting member 50. Further, when an intermediate cylinder is provided between the inner cylinder 10 and the outer cylinder 20, the intermediate cylinder can be provided directly on the outer peripheral surfaces of both diameter-increased end portions of the inner cylinder 10 in the axial direction.

Since the heat of the first fluid circulating the heat recovery member is transmitted to the inner cylinder 10 via the heat recovery member, the inner cylinder 10 is preferably formed of a material having good heat conductivity. Examples of a material used for the inner cylinder 10 include, metals, ceramics, and the like. Examples of the metals include stainless steel, titanium alloys, copper alloys, aluminum alloys, and brass. The material of the inner cylinder 10 is preferably stainless steel because of its higher durability and reliability.

<Regarding Outer Cylinder 20>

The outer cylinder 20 is a cylindrical member disposed so as to be spaced on a radially outer side of the inner cylinder 10.

The outer cylinder 20 may have any shape such as a cylindrical shape having a circular cross section perpendicular to the axial direction, a rectangular cylindrical shape having a triangular, quadrangular, pentagonal, or hexagonal cross section, and an elliptical cylindrical shape having an elliptical cross section, although not particularly limited thereto. Among them, the outer cylinder 20 is preferably cylindrical.

The outer cylinder 20 may be arranged coaxially with the inner cylinder 10. More particularly, an axial direction of the outer cylinder 20 may coincide with that of the inner cylinder 10, and a central axis of the outer cylinder 20 may coincide with that of the inner cylinder 10.

It is preferable that an axial length of the outer cylinder 20 is set to be longer than that of the heat recovery member housed in the inner cylinder 10. In the axial direction of the outer cylinder 20, a center position of the outer cylinder 20 preferably coincide with that of the inner cylinder 10.

Diameters (outer and inner diameters) of the outer cylinder 20 are not particularly limited. However, it is preferable that the diameters of both end portions in the axial direction are decreased. Such a structure can allow the outer cylinder 20 to be directly joined to the inner cylinder 10, thus eliminating any need for a connecting member 50. Further, when an intermediate cylinder is provided between the inner cylinder 10 and the outer cylinder 20, the intermediate cylinder can be provided directly on the outer peripheral surfaces of both diameter-decreased end portions of the outer cylinder 10 in the axial direction.

The outer cylinder 20 can preferably be made of, for example, a metal or ceramics. Examples of metal include stainless steel, titanium alloys, copper alloys, aluminum alloys, brass and the like. Among them, the material of the outer cylinder 20 is preferably the stainless steel because it has higher durability and reliability.

The outer cylinder 20 has the feed port 21 capable of feeding the second fluid and the discharge port 22 capable of discharging the second fluid. The positions of the feed port 21 and the discharge port 22 are not particularly limited as long as they are provided so as to be located in a distance of less than half the circumference of the outer cylinder 20 in the circumferential direction.

For example, as shown in FIG. 2, the feed port 21 and the discharge port 22 can be provided such that the feed port 21 and the discharge port 22 are located on the same circumference of the outer cylinder 20. More preferably, the feed port 21 and the discharge port 22 can be provided such that a central portion P1 of the feed port 21 and a central portion P2 of the discharge port 22 are located on the same circumference of the outer cylinder 20. As used herein, the phrase "a central portion P1 of the feed port 21 and a central portion P2 of the discharge port 22 are located on the same circumference of the outer cylinder 20" means that the central portion P1 of the feed port 21 and the central portion P2 of the discharge port 22 are located on one circumference line L orthogonal to the axial direction of the cylinder 20.

Figure 9:
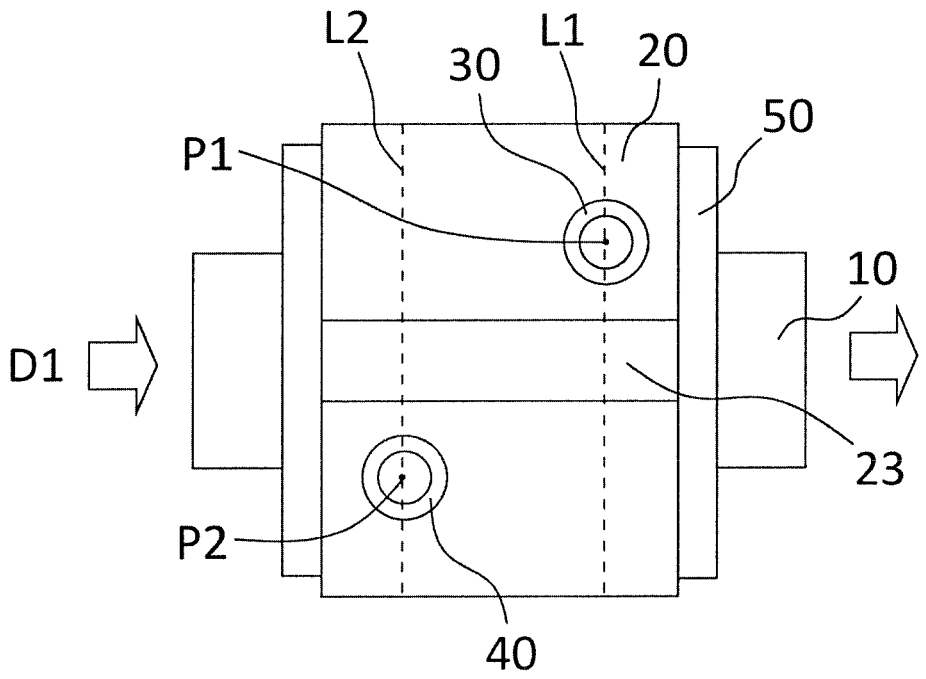
FIG. 9 is a top view of a flow path member for another heat exchanger according to Embodiment 1 of the present invention.

Further, the feed port 21 and the discharge port 22 may be provided such that the feed port 21 and the discharge port 22 are located on different circumferences of the outer cylinder 20. FIG. 9 shows a top view of the flow path member for the heat exchanger according to such an embodiment. As used herein, the phrase "the feed port 21 and the discharge port 22 are located on different circumferences of the outer cylinder 20" means that the central portion P1 of the feed port 21 and the central portion P2 of the discharge port 22 are located on two circumference lines L1 and L2, respectively, which are each orthogonal to the axial direction of the outer cylinder 20. By thus providing the feed port 21 and the discharge port 22, the flow direction D2 of the second fluid is opposed to the flow direction D1 of the first fluid, so that the heat recovery amount can be increased.

<Regarding Feed Pipe 30 and Discharge Pipe 40>

The feed pipe 30 and the discharge pipe 40 are tubular members through which the second fluid can flow.

The feed pipe 30 and the discharge pipe 40 are connected to the feed port 21 and the discharge port 22, respectively. The connection method may be known methods, including, but not limited to, shrink fitting, press fitting, brazing, and diffusion bonding.

Each of the feed pipe 30 and the discharge pipe 40 may have any shape such as a cylindrical shape having a circular cross section perpendicular to the axial direction, a rectangular cylindrical shape having a triangular, quadrangular, pentagonal, or hexagonal cross section, and an elliptical cylindrical shape having an elliptical cross section, although not particularly limited thereto. Among them, the each of the feed pipe 30 and the discharge pipe 40 is preferably cylindrical.

Figure 10:
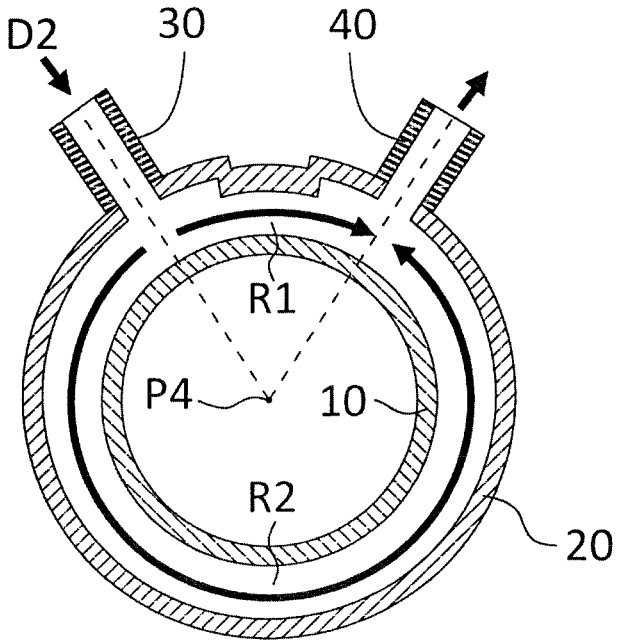
FIG. 10 is a cross-sectional view of a flow path member for another heat exchanger according to Embodiment 1 of the present invention in a direction orthogonal to an axial direction of an outer cylinder and an inner cylinder.

The axial direction of each of the feed pipe 30 and the discharge pipe 40 is not particularly limited. For example, in a cross section perpendicular to the axial direction of the outer cylinder 20, the feed pipe 30 and the discharge pipe 40 may be configured such that the axial direction is oriented toward a central portion P4 of the outer cylinder 20 as shown in FIG. 10, or the feed pipe 30 and the discharge pipe 40 may be configured such that the axial direction is oriented toward the flow path R2 for the second fluid on the longer circumference side, as shown in FIGS. 3 to 8. Especially, by configuring the feed pipe 30 and the discharge pipe 40 such that the axial direction of each of the feed pipe 30 and the discharge pipe 40 is oriented toward the flow path R2 for the second fluid on the longer circumference side, the second fluid is facilitated to flow through the flow path R2 for the second fluid on the longer circumference side, so that an opportunity to bring the second fluid into contact with the inner cylinder 10 can be increased, and the heat recovery amount can be increased.

Figure 11:
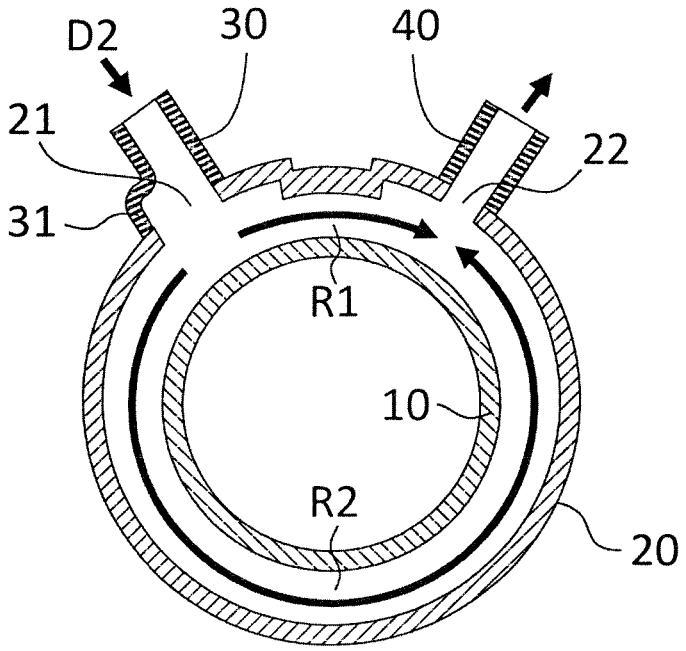
FIG. 11 is a cross-sectional view of a flow path member for another heat exchanger according to Embodiment 1 of the present invention in a direction orthogonal to an axial direction of an outer cylinder and an inner cylinder.

Further, as shown in FIG. 11, in the cross section perpendicular to the axial direction of the outer cylinder 20, a buffer portion 31 may be provided at the end portion of the feed pipe 30 on the feed port 21 side, and the buffer portion 31 may be formed such that the second fluid preferentially flow through the flow path R2 for the second fluid on the longer circumference side. Although FIG. 11 shows an example in which the buffer portion 31 is provided at the feed pipe 30, the buffer portion may be provided at the end portion of the discharge pipe 40 on the discharge port 22 side. Such a configuration can provide an increased opportunity to bring the second fluid into contact with the inner cylinder 10, so that the heat recovery amount can be increased.

The feed pipe 30 and the discharge pipe 40 can preferably be made of, for example, a metal or ceramics. Examples of the metal include stainless steel, titanium alloys, copper alloys, aluminum alloys, brass and the like. Among them, the material of each of the feed pipe 30 and the discharge pipe 40 is preferably the stainless steel because it has higher durability and reliability.

Figure 12:
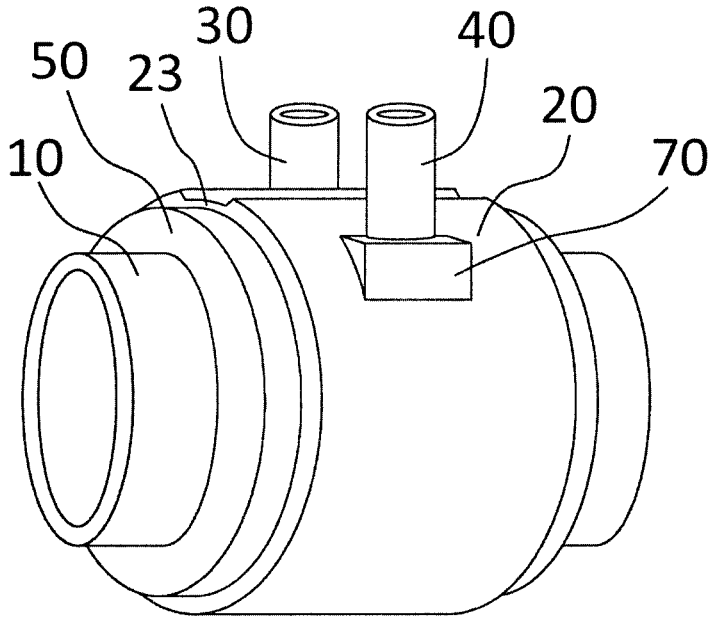
FIG. 12 is a perspective view of a flow path member for another heat exchanger according to Embodiment 1 of the present invention.

The feed pipe 30 and the discharge pipe 40 may be fitted into the feed port 21 and the discharge port 22, respectively, via a flow adjustment portion 70, as shown in FIG. 12.

When the feed pipe 30 and the discharge pipe 40 are directly fitted into the feed port 21 and the discharge port 22 of the outer cylinder 20, the second fluid may stagnate and boil around the fitted portion of the feed port 30 and the discharge port 40, causing problems such as 1) to 3) as described below:

1) The heat exchanger becomes locally hot, causing defects of the heat exchanger itself.

2) The heat is excessively recovered.

3) Generated bubbles (vapor) degrade the characteristics of other components.

By fitting the feed pipe 30 and the discharge pipe 40 into the feed port 21 and the discharge port 22, respectively, via the flow adjustment portion 70, the stagnation of the second fluid around the fitted portion of the feed pipe 30 and the discharge pipe 40 can be suppressed.

The structure of the flow adjustment portion 70 is not particularly limited as long as it can adjust the flow of the second fluid, but it is preferable that the flow adjustment portion has a structure provided at a part of the outer cylinder 20 in the outer circumferential direction and expanding outward in the radial direction of the outer cylinder 20. Such a structure can allow the stagnation of the second fluid around the fitted portion of the feed pipe 30 and the discharge pipe 40 to be stably suppressed.

It is preferable that the flow adjustment portion 70 has at least one planar region, and the planar region is provided with the fitted portion of the feed pipe 30 and the discharge pipe 40. Such a structure can provide easy joining of the feed pipe 30 and the discharge pipe 40 to the flow adjustment portion 70.

<Regarding Connecting Member 50>

The connecting member 50 is a tubular member that connects an upstream side of the inner cylinder 10 to an upstream side of the outer cylinder 20, and a downstream side of the inner cylinder 10 to a downstream side of the outer cylinder 20, as needed.

As described above, it should be noted that it is not necessary to provide the connecting member 50 as long as the inner cylinder 10 and the outer cylinder 20 are directly connected to each other by increasing the diameters of the inner cylinder 10 on the upstream side and the downstream side, and/or decreasing the diameters of the outer cylinder 20 on the upstream side and the downstream side.

The axial direction of the connecting member 50 is preferably arranged coaxially with the inner cylinder 10 and the outer cylinder 20. More particularly, the axial direction of the connecting member 50 may preferably coincide with that of each of the inner cylinder 10 and the outer cylinder 20, and the central axis of the connecting member 50 may preferably coincide with that of each of the inner cylinder 10 and the outer cylinder 20.

The connecting member 50 has a flange portion for connecting the inner cylinder 10 to the outer cylinder 20. The flange portion may have various known shapes, although not particularly limited.

The material used for the connecting member 50 is not particularly limited, and the same materials as those illustrated for the inner cylinder 10 and the outer cylinder 20 may be used.

<Regarding Intermediate Cylinder>

The intermediate cylinder can optionally be provided between the inner cylinder 10 and the outer cylinder 20.

The intermediate cylinder may have any shape such as a cylindrical shape having a circular cross section perpendicular to the axial direction, a rectangular cylindrical shape having a triangular, quadrangular, pentagonal, or hexagonal cross section, and an elliptical cylindrical shape having an elliptical cross section, although not particularly limited thereto. Among them, the intermediate cylinder 20 is preferably cylindrical.

It is preferable that an axial direction of the intermediate cylinder coincides with that of each of the inner cylinder 10 and the outer cylinder 20, and a center axis of the intermediate cylinder coincides with that of each of the inner cylinder 10 and the outer cylinder 20.

It is preferable that an axial length of the intermediate cylinder is longer than that of the heat recovery member housed in the inner cylinder 10. In the axial direction of the intermediate cylinder, the central position of the intermediate cylinder 30 preferably coincides with that of the outer cylinder 20.

The intermediate cylinder is arranged between the inner cylinder 10 and the outer cylinder 20, and forms a first flow path which can allow the second fluid to flow between the outer cylinder 20 and the intermediate cylinder, and a second flow path which can allow the second flow path to flow between the inner cylinder 10 and the intermediate cylinder.

The intermediate cylinder has at least one communication hole which can allow the second fluid to flow between the first flow path and the second flow path. Such a structure can allow the second fluid to be circulated in the second flow path.

The shape of the communication hole is not particularly limited as long as it allows the second fluid to flow, and it can be, for example, various shapes such as a circular shape, an elliptical shape, and a polygonal shape. Further, a slit may be provided as the communication hole along the axial direction or the circumferential direction of the inner cylinder.

The number of communication holes is not particularly limited, and there may be a plurality of communication holes in the axial direction of the inner cylinder. In general, the number of communication holes may be appropriately set depending on the shape of the communication hole.

When the second flow path is filled with the liquid second fluid, the heat of the first fluid transmitted from the heat recovery member to the inner cylinder 10 is transmitted to the second fluid in the first flow path via the second fluid in the second flow path. On the other hand, when a temperature of the inner cylinder 10 is higher and vapor (bubbles) of the second fluid is generated in the second flow path, the thermal conduction of the second fluid in the first flow path via the second fluid in the second flow path is suppressed. This is because thermal conductivity of a gaseous fluid is lower than that of a liquid fluid. That is, a state where heat exchange is promoted and a state where heat exchange is suppressed can be switched depending on whether or not the second fluid in the gaseous state is generated in the second flow path. The states of heat exchange do not require any external control. Therefore, the providing of the intermediate cylinder can allow for easy switching between promotion and suppression of heat exchange between the first fluid and the second fluid without external control.

It should be noted that the second fluid may be a fluid having a boiling point in a temperature range in which heat exchange is to be suppressed.

In another embodiment, the flow path member 100 for the heat exchanger may have the following configuration:

A flow path member 100 for a heat exchanger, including:

an inner cylinder 10 capable of housing a heat recovery member through which a first fluid can flow; an outer cylinder 20 having a feed port 21 capable of feeding a second fluid and a discharge port 22 capable of discharging the second fluid, the outer cylinder 20 being disposed so as to be spaced on a radially outer side of the inner cylinder 10 such that a flow path R1, R2 for the second fluid is formed between the outer cylinder 20 and the inner cylinder 10; a feed pipe 30 connected to the feed port 21; and a discharge pipe 40 connected to the discharge port 22, wherein the feed port 21 and the discharge port 22 are provided so as to be located in a distance of less than half the circumference of the outer cylinder 20 in a circumferential direction 20, wherein the feed port 21 and the discharge port 22 are located on the same circumference of the outer cylinder 20, and wherein the flow path member 100 includes at least one of a flow path resistance increasing structure portion 23 provided at the flow path R1 for the second fluid on a shorter circumference side between the feed port 21 and the discharge port 22, and a flow path resistance increasing member 60 provided at the flow path R1 for the second fluid on the shorter circumference side between the feed port 21 and the discharge port 22.

The flow path member 100 for the heat exchanger having such a configuration can also improve the heat recovery amount.

The flow path member 100 for the heat exchanger according to Embodiment 1 of the present invention having the above structure can be produced according to a known method. More particularly, the flow path member for the heat exchanger according to Embodiment 1 of the present invention can be produced as follows:

First, the inner cylinder 10 is prepared. When the flow path resistance increasing structure portion 23 is provided on the outer peripheral surface of the inner cylinder 10, the flow path resistance increasing structure portion 23 is formed by a forming process or the like. When the flow path resistance increasing member 60 is arranged on the outer peripheral surface of the inner cylinder 10, the flow path resistance increasing member 60 is placed on the outer peripheral surface of the inner cylinder 10 and fixed by welding or the like. Examples of the forming process include pressing and embossing.

Similarly, when the outer cylinder 20 provided with the feed pipe 30 and the discharge pipe 40 is prepared. When the flow path resistance increasing structure portion 23 is provided on the inner peripheral surface of the outer cylinder 20, the flow path resistance increasing structure portion 23 is formed by a forming process or the like. When the flow path resistance increasing member 60 is arranged on the inner peripheral surface of the outer cylinder 20, the flow path resistance increasing member 60 is arranged on the inner peripheral surface of the outer cylinder 20 and fixed by welding or the like.

Subsequently, the inner cylinder 10 as described above is arranged in the outer cylinder 20 as described above and fixed by welding or the like.

It should be noted that the above production method is merely illustrative, and the order of steps can be changed as needed.

Since the flow path member 100 for the heat exchanger according to Embodiment 1 of the present invention has the structure as described above, the heat recovery amount can be improved.

(2) Heat Exchanger

The heat exchanger according to Embodiment 1 of the present invention includes the flow path member 100 for the heat exchanger as described above and a heat recovery member housed in the inner cylinder 10.

The heat recovery member is not particularly limited as long as it can recover heat. For example, a honeycomb structure can be used as the heat recovery member.

The honeycomb structure is generally a pillar shaped structure. A cross-sectional shape orthogonal to an axial direction of the honeycomb structure is not particularly limited, and it may be a circle, an ellipse, a quadrangle, or other polygons.

The honeycomb structure has an outer peripheral wall, and a partition wall which is arranged inside the outer peripheral wall and define a plurality of cells forming flow paths each extending from a first end face to a second end face.

The partition wall and the outer peripheral wall contain ceramics as main components. The first end face and the second end face are end faces on both sides of the honeycomb structure in the axial direction (a cell extending direction).

Each cell may have any cross-sectional shape (a shape of a cross section perpendicular to the cell extending direction), including, but not particularly limited to, circular, elliptical, triangular, quadrangular, hexagonal and other polygonal shapes.

Also, the cells may be radially formed in a cross section in a direction perpendicular to the cell extending direction. Such a structure can allow heat of the first fluid flowing through the cells to be efficiently transmitted to the outside of the honeycomb structure.

The outer peripheral wall preferably has a thickness larger than that of the partition wall. Such a structure can lead to increased strength of the outer peripheral wall which would otherwise tend to generate breakage (e.g., cracking, chinking, and the like) by thermal stress or the like due to a difference between temperatures of the first fluid and the second fluid.

A thickness of the partition wall is not particularly limited, and it may be adjusted as needed depending on applications. For example, the thickness of the partition wall may preferably be from 0.1 to 1 mm, and more preferably from 0.2 to 0.6 mm. The thickness of the partition wall of 0.1 mm or more can ensure a sufficient mechanical strength of the honeycomb structure. Further, the thickness of the partition wall of 1 mm or less can suppress problems that the pressure loss is increased due to a decrease in an opening area and the heat recovery efficiency is decreased due to a decrease in a contact area with the first fluid.

The honeycomb structure can be produced as follows:

First, a green body containing ceramic powder is extruded into a desired shape to prepare a honeycomb formed body. The material of the honeycomb formed body is not particularly limited, and a known material can be used. For example, when producing a honeycomb formed body containing a Si-impregnated SiC composite as a main component, a binder and water or an organic solvent are added to a predetermined amount of SiC powder, and the resulting mixture is kneaded to form a green body, which can be then formed into a honeycomb formed body having a desired shape.

The resulting honeycomb formed body can be then dried, and the dried honeycomb formed body can be impregnated with metallic Si and fired in an inert gas under reduced pressure or in vacuum to obtain a honeycomb structure having cells serving as flow paths for the first fluid, defined by the partition wall.

When the honeycomb structure is housed in the inner cylinder 10, the honeycomb structure may be inserted into the inner cylinder 10, arranged at a certain position, and then shrink-fitted. In this case, press fitting, brazing, diffusion bonding, or the like may be used in place of the shrink fitting.

Since the heat exchanger according to Embodiment 1 of the present invention uses the flow path member 100 for the heat exchanger, the heat recovery amount can be improved.

Embodiment 2

Figure 13:
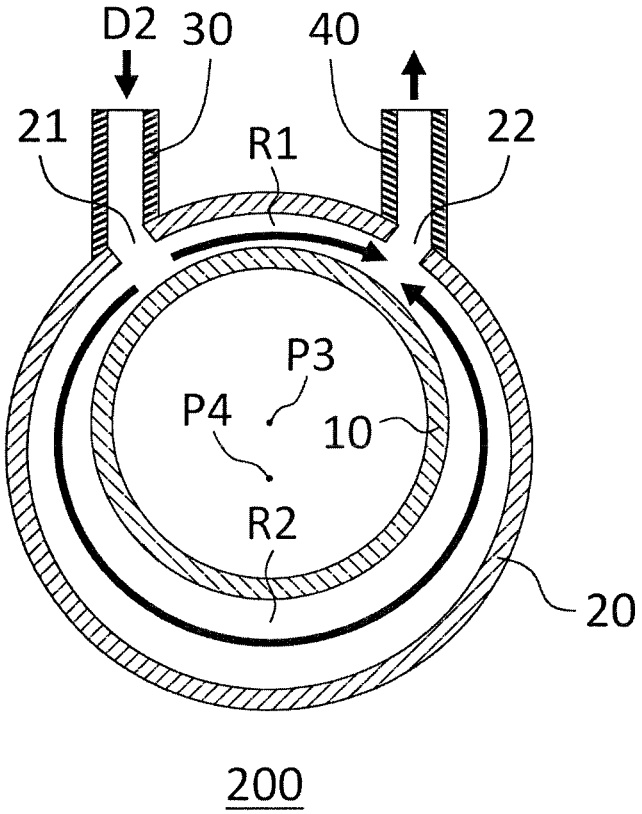
FIG. 13 is a cross-sectional view of a flow path member for a heat exchanger according to Embodiment 2 of the present invention in a direction orthogonal to an axial direction of an outer cylinder and an inner cylinder.

FIG. 13 is a cross-sectional view of a flow path member for a heat exchanger according to Embodiment 2 of the present invention in a direction orthogonal to an axial direction of an outer cylinder and an inner cylinder.

It should be noted that, in the descriptions of a flow path member 200 for a heat exchanger according to Embodiment 2 of the present invention, the components having the same reference numerals as those appearing in the descriptions of the flow path member 100 for the heat exchanger according to Embodiment 1 of the present invention are the same as those of the flow path member 200 for the heat exchanger according to Embodiment of the present invention. Therefore, detailed descriptions of those components will be omitted.

The flow member 200 for the heat exchanger according to Embodiment 2 of the present invention is different from the flow member 100 for the heat exchanger according to Embodiment 1 in the method of providing the higher flow path resistance for the second fluid on the shorter circumference side between the feed port 21 and the discharge port 22 than the flow path resistance for the second fluid on the longer circumference side between the feed port 21 and the discharge port 22, and is otherwise the same as the flow member 100 for the heat exchanger according to Embodiment 1.

That is, in the flow member 200 for the heat exchanger according to Embodiment 2 of the present invention, the inner cylinder 10 is eccentric such that the central portion P3 of the inner cylinder 10 is located on the feed port 21 and discharge port 22 side relative to the central portion P4 of the outer cylinder 20 in the cross section perpendicular to the flow direction D1 of the first fluid. Such an eccentric inner cylinder 10 can increase the flow path resistance for the second fluid on the shorter circumference side where the distance between the feed port 21 and the discharge port 22 is shorter, so that the rate of the second fluid passing through the flow path R2 on the longer circumference side where the distance between the feed port 21 and the discharge port 22 is longer can be increased, thereby increasing the heat recovery amount.

The flow path member 200 for the heat exchanger according to Embodiment 2 of the present invention can be produced by arranging the inner cylinder 10 inside the outer cylinder 20 such that the inner cylinder 10 is eccentric, and fixing them by welding or the like.

The flow path member 200 for the heat exchanger according to Embodiment 2 of the present invention has higher productivity and lower production cost than those of the flow path member 100 for the heat exchanger according to Embodiment 1 of the present invention, because in the former, there is no need to provide the flow path resistance increasing structure portion 23 at the flow path R1 for the second fluid on the shorter circumference side between the feed port 21 and the discharge port 22, or to provide the flow path resistance increasing member 60 at the flow path R1 for the second fluid on the shorter circumference side between the feed port 21 and the discharge port 22.

However, from the viewpoint of a fine adjustment of the rate of the second fluid passing through the flow path R1, R2 for the second fluid, the flow path resistance increasing structure portion 23 may be provided at the flow path R1 for second fluid on the shorter circumference side between the feed port 21 and the discharge port 22, or the flow path resistance increasing member 60 may be provided at the flow path R1 for the second fluid on the shorter circumference side between the feed port 21 and the discharge port 22.

In another embodiment, the flow path member 200 for the heat exchanger according to Embodiment 2 of the present invention may have the following configuration:

A flow path member 200 for a heat exchanger, including:

an inner cylinder 10 capable of housing a heat recovery member through which a first fluid can flow; an outer cylinder 20 having a feed port 21 capable of feeding a second fluid and a discharge port 22 capable of discharging the second fluid, the outer cylinder 20 being disposed so as to be spaced on a radially outer side of the inner cylinder 10 such that a flow path R1, R2 for the second fluid is formed between the outer cylinder 20 and the inner cylinder 10; a feed pipe 30 connected to the feed port 21; and a discharge pipe 40 connected to the discharge port 22, wherein the feed port 21 and the discharge port 22 are provided so as to be located in a distance of less than half the circumference of the outer cylinder 20 in a circumferential direction 20, wherein the feed port 21 and the discharge port 22 are located on the same circumference of the outer cylinder 20, and wherein, in a cross section orthogonal to a flow direction D1 of the first fluid, the inner cylinder 10 is eccentric such that a central portion P3 of the inner cylinder 10 is located on the feed port 21 and discharge port 22 side relative to a central portion P4 of the outer cylinder 20.

The flow path member 200 for the heat exchanger having such a configuration also can improve the heat recovery amount.

The heat exchanger according to Embodiment 2 of the present invention includes the flow path member 200 for the heat exchanger and the heat recovery member housed in the inner cylinder 10. Since the heat exchanger uses the flow path member 200 for the heat exchanger as described above, the heat recovery amount can be improved.

DESCRIPTION OF REFERENCE NUMERALS

10 inner cylinder
20 outer cylinder

21 feed port
22 discharge port
23 flow path resistance increasing structure
30 feed pipe
31 buffer portion
40 discharge pipe
50 connecting member
60 flow path resistance increasing member
70 flow adjustment portion
100,200 flow path member for heat exchanger
R1, R2 flow path for second fluid
D1 flow direction of first fluid
D2 flow direction of second fluid

The invention claimed is:

1. A flow path member for a heat exchanger, comprising:
an inner cylinder capable of housing a heat recovery member through which a first fluid can flow;
an outer cylinder having a feed port capable of feeding a second fluid and a discharge port capable of discharging the second fluid, the outer cylinder being disposed so as to be spaced on a radially outer side of the inner cylinder such that a flow path for the second fluid is formed between the outer cylinder and the inner cylinder;
a feed pipe connected to the feed port; and
a discharge pipe connected to the discharge port,
wherein the feed port and the discharge port are provided so as to be located in a distance of less than half the circumference of the outer cylinder in a circumferential direction,
wherein resistance of the flow path for the second fluid on a shorter circumference side between the feed port and the discharge port is higher than that of the flow path for the second fluid on a longer circumference side between the feed port and the discharge port,
wherein the feed port and the discharge port are located on the same circumference of the outer cylinder, and
wherein the feed pipe and the discharge pipe are connected to the feed port and discharge port, respectively, without intruding into the second flow path.

2. The flow path member for a heat exchanger according to claim 1, wherein the feed pipe and the discharge pipe are fitted into the feed port and the discharge port, respectively, via a flow adjustment portion.

3. The flow path member for a heat exchanger according to claim 1, wherein the flow path member comprises at least one of a flow path resistance increasing structure portion provided at the flow path for the second fluid on the shorter circumference side between the feed port and the discharge port, and a flow path resistance increasing member provided at the flow path for the second fluid on the shorter circumference side between the feed port and the discharge port.

4. The flow path member for a heat exchanger according to claim 3, wherein the flow path resistance increasing structure portion and/or the flow path resistance increasing member are provided along a flow direction of the first fluid.

5. The flow path member for a heat exchanger according to claim 3, wherein the flow path resistance increasing structure portion and/or the flow path resistance increasing member have a structure capable of partially decreasing a cross-sectional area of the flow path for the second fluid.

6. The flow path member for a heat exchanger according to claim 3, wherein the flow path resistance increasing structure portion and/or the flow path resistance increasing member have a bellows structure.

7. The flow path member for a heat exchanger according to claim 1, wherein, in a cross section orthogonal to a flow direction of the first fluid, the inner cylinder is eccentric such that a central portion of the inner cylinder is located on the feed port and discharge port side relative to a central portion of the outer cylinder.

8. A heat exchanger, comprising:
the flow path member for a heat exchanger according to claim 1; and
a heat recovery member housed in the inner cylinder.

9. The heat exchanger according to claim 8, wherein the heat recovery member is a honeycomb structure comprising: an outer peripheral wall; and a partition wall arranged inside the outer peripheral wall, the partition wall defining a plurality of cells, each of the cells forming a flow path extending from a first end face to a second end face.

10. A flow path member for a heat exchanger, comprising:
an inner cylinder capable of housing a heat recovery member through which a first fluid can flow;
an outer cylinder having a feed port capable of feeding a second fluid and a discharge port capable of discharging the second fluid, the outer cylinder being disposed so as to be spaced on a radially outer side of the inner cylinder such that a flow path for the second fluid is formed between the outer cylinder and the inner cylinder;
a feed pipe connected to the feed port; and
a discharge pipe connected to the discharge port,
wherein the feed port and the discharge port are provided so as to be located in a distance of less than half the circumference of the outer cylinder in a circumferential direction,
wherein the feed port and the discharge port are located on the same circumference of the outer cylinder,
wherein the flow path member comprises at least one of a flow path resistance increasing structure portion provided at the flow path for the second fluid on a shorter circumference side between the feed port and the discharge port, and a flow path resistance increasing member provided at the flow path for the second fluid on the shorter circumference side between the feed port and the discharge port, and
wherein the feed pipe and the discharge pipe are connected to the feed port and discharge port, respectively, without intruding into the second flow path.

11. A flow path member for a heat exchanger, comprising:
an inner cylinder capable of housing a heat recovery member through which a first fluid can flow;
an outer cylinder having a feed port capable of feeding a second fluid and a discharge port capable of discharging the second fluid, the outer cylinder being disposed so as to be spaced on a radially outer side of the inner cylinder such that a flow path for the second fluid is formed between the outer cylinder and the inner cylinder;
a feed pipe connected to the feed port; and
a discharge pipe connected to the discharge port,
wherein the feed port and the discharge port are provided so as to be located in a distance of less than half the circumference of the outer cylinder in a circumferential direction,
wherein the feed port and the discharge port are located on the same circumference of the outer cylinder, and
wherein, in a cross section orthogonal to a flow direction of the first fluid, the inner cylinder is eccentric such that a central portion of the inner cylinder is located on the feed port and discharge port side relative to a central portion of the outer cylinder.

* * * * *